United States Patent [19]

Marsh, Jr.

[11] Patent Number: 4,537,534

[45] Date of Patent: Aug. 27, 1985

[54] DRIVE FIT COUPLING FOR PRECAST CONCRETE PILES

[76] Inventor: Richard O. Marsh, Jr., 401 Standard Life Bldg., Pittsburgh, Pa. 15222

[21] Appl. No.: 507,765

[22] Filed: Jun. 27, 1983

[51] Int. Cl.[3] ..... E02D 5/00; E02D 5/72

[52] U.S. Cl. ..... 405/252; 405/251; 403/305; 403/282

[58] Field of Search ..... 405/251, 252; 403/305, 403/314, 282; 285/382.4

[56] References Cited

U.S. PATENT DOCUMENTS

| | | | |
|---|---|---|---|
| 1,976,776 | 10/1934 | Gookin | 411/15 |
| 2,865,290 | 12/1958 | Bonsper | 403/282 X |
| 3,172,507 | 3/1965 | Blyveis | 403/305 X |
| 3,540,224 | 11/1970 | Pogonowski . | |
| 3,555,831 | 1/1971 | Pogonowski . | |
| 3,762,173 | 10/1973 | Marsh . | |
| 3,796,057 | 3/1974 | Dougherty | 403/305 X |
| 3,915,481 | 10/1975 | Marsh, Jr. | 285/176 |
| 3,924,413 | 12/1975 | Marsh | 405/251 |
| 3,958,817 | 5/1976 | Marsh, Jr. | 285/16 |
| 4,382,721 | 5/1983 | King | 405/288 |

*Primary Examiner*—Dennis L. Taylor

*Attorney, Agent, or Firm*—Walter J. Blenko, Jr.; Arnold B. Silverman

[57] ABSTRACT

A drive fit coupling for joining together a pair of plain end concrete piles each having a polygonal cross sectional configuration is disclosed. A metal sleeve is provided in which a portion of the perimeter of the sleeve wall expands outwardly as the piles are driven into the sleeve causing the sleeve to fit tightly over the ends of the piles. The friction of the sleeve around the pile ends is sufficient to resist bending thereby keeping the joined piles straight during driving. Center stopping means is also provided to prevent a pile from entering the sleeve beyond the vertical center thereof.

2 Claims, 7 Drawing Figures

FIG. 5
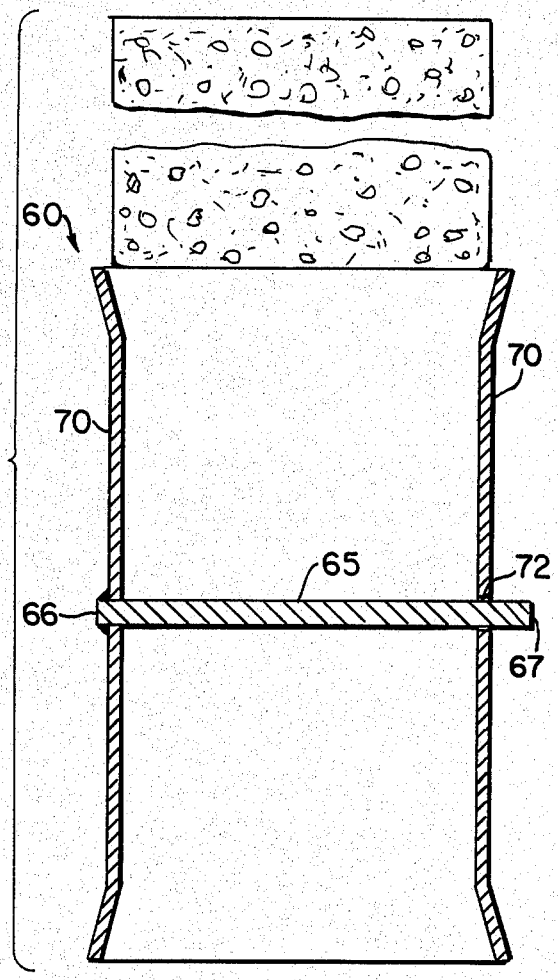
FIG. 6
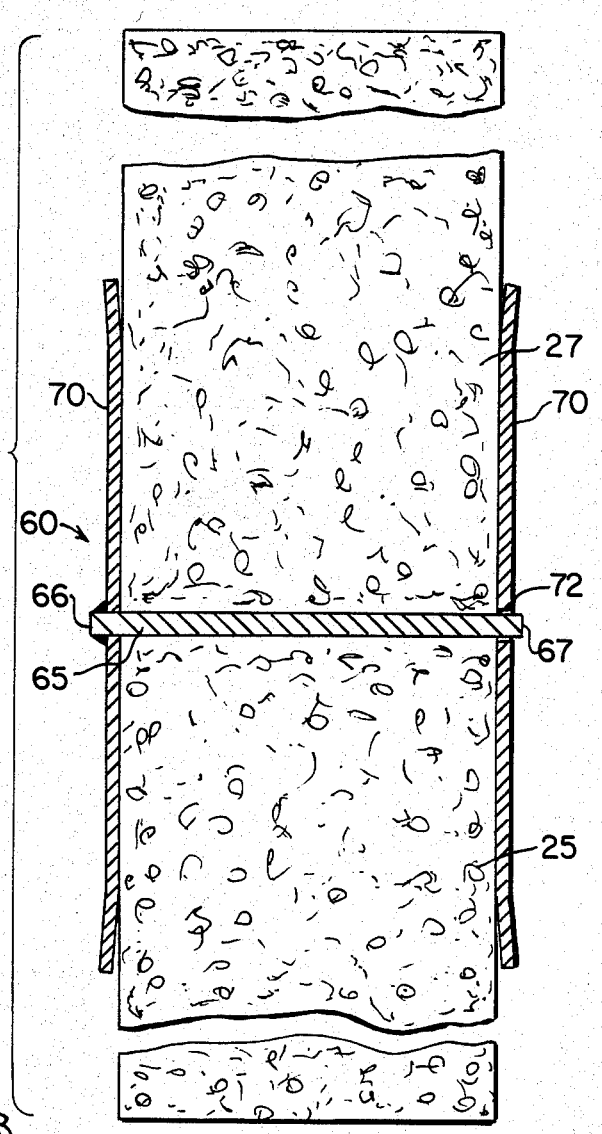
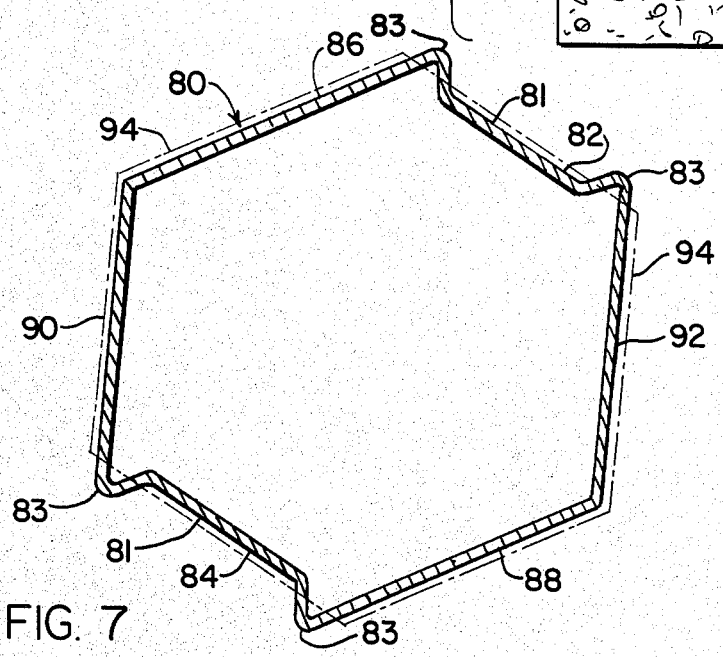
FIG. 7

DRIVE FIT COUPLING FOR PRECAST CONCRETE PILES

This invention relates to a new and improved coupling for joining a pair of plain-end precast concrete piles having various polygonal cross sectional configurations. More specifically, a metal sleeve is provided in which a portion of the sleeve expands outwardly as a pile is driven into the sleeve causing it to fit tightly over the end of the pile. Center stopping means is provided to prevent a pile from entering the sleeve beyond the center of the sleeve.

The use of precast concrete piles is well-known in the art. Often times, however, piles must be driven to depths which exceed the maximum length that it is feasible to handle or drive a single pile. Therefore, it is often required that one or more additional lengths of piling be added to the already driven lengths. Although a number of methods have been suggested to join or splice together two or more single piles, it is possible to divide splices generally into those which are primarily tension splices and those which are non-tension splices.

Tension splices typically comprise a plate anchored to an end of each pile and some type of locking means to secure the two end plates together. Various types of tension splices are known, but most utilize a plate which is welded or otherwise secured to rods which are formed as an intergal part of the pile thereby providing a means to anchor the plate to the pile end. Tension splices are used when a pile will be subject to tensile forces as might be developed in tall buildings by wind or in structures having box type foundations where high water levels might cause the structure to float. In most instances, however, the piles are only subject to compression loads except that bending stresses may develop during driving. In order to provide the bending resistance required to keep the piles straight during driving, many builders use tension splices even though the finished structure does not require them. Tension splices currently available to the industry are generally quite expensive and typically require considerable time to install.

A typical non-tension splice would be a sleeve having an identical cross sectional configuration as the pile for which it was designed. Providing a sleeve of proper size is a difficult task and often there is a gap around the perimeter of the pile end inserted into the sleeve. Non-tension splices available to the industry are less expensive but frequently cannot be used because they do not offer sufficient resistance to bending.

An additional problem with existing splicing methods, both tension and non-tension, is that they require either special end preparation of the piles or special time consuming preparation in the field.

There is, therefore, a need for a relatively inexpensive coupling means for precast concrete piles which can be used without special pile end preparation, which provide a high degree of bending resistance and which can be rapidly installed.

I provide expandable metal sleeve coupling means having the same general cross sectional configuration as the pile end, a portion of the sleeve perimeter extending inwardly to encroach upon space enclosed by the sleeve which will be occupied by the end of a pile.

I prefer to provide coupling means also having a portion of the sleeve perimeter extending outwardly away from the space which will ultimately be occupied by the end of the pile to allow sufficient sleeve material for a pile end to enter the sleeve.

I provide coupling means in which an inwardly extending portion of the sleeve perimeter is deformed outwardly upon the entry of a pile causing the sleeve to fit tightly over the pile end. I further provide coupling means which engages the pile end with sufficient friction to resist bending and keep the joined piles straight during driving. I still further provide coupling means which offers some resistance to tensile forces.

I prefer to provide coupling means having outwardly flaring enter end portions to aid in aligning and engaging together the sleeve and the pile ends.

In one embodiment, I prefer to utilize stopping means consisting of two plates each having one end welded to opposite sides of the sleeve thereby allowing the sleeve to expand while preventing either pile from passing beyond the vertical center of the coupling.

In another embodiment, I prefer to utilize stopping means in which one end of a horizontal plate is attached to one side of the sleeve and the opposite end thereof extends through a slot provided in the opposite side of the sleeve to allow the sleeve to expand as the pile is driven into the coupling.

Finally, I prefer to provide coupling means which can easily be adapted for use with piles having any polygonal cross sectional configuration.

In the accompanying drawings I have illustrated certain present preferred embodiments of my invention in which:

FIG. 5 is a longitudinal sectional view corresponding to the view in FIG. 2 of a modified coupling;

FIG. 6 is a longitudinal sectional view of the coupling of FIG. 5 as expanded by the insertion of a pair of pile ends; and FIG. 7 is a transverse sectional view corresponding to the view in FIG. 3 of a coupling for use with hexagonal cross section piling.

Figure 1:
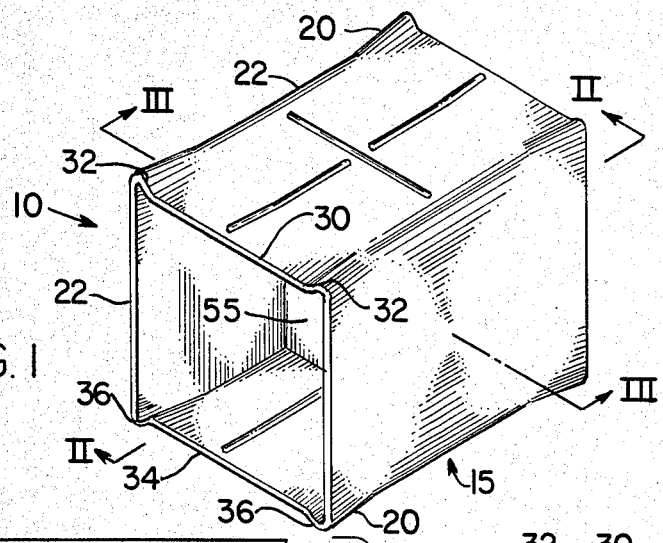
FIG. 1 is an isometric view of a coupling for use with square cross section piles.
Figure 2:
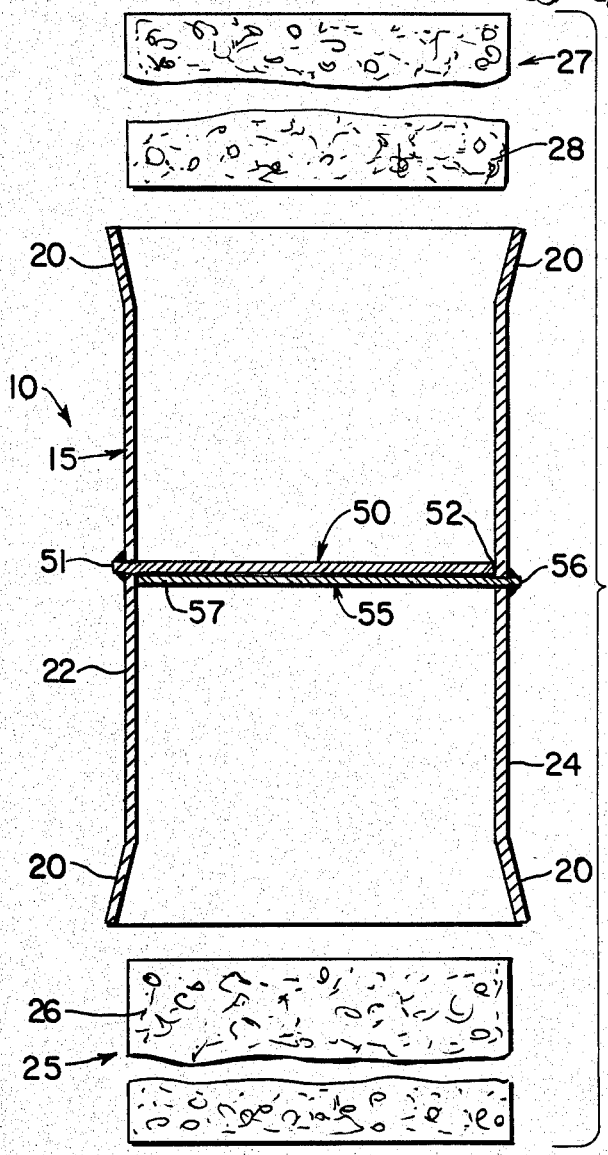
FIG. 2 is a longitudinal sectional view of the coupling taken generally on the plane II—II of FIG. 1 also showing piles aligned for insertion therein.
Figure 3:
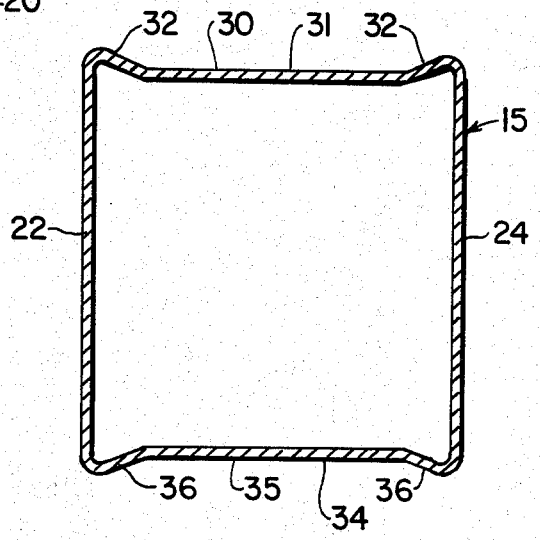
FIG. 3 is a transverse sectional view of the coupling taken generally on the plane III—III of FIG. 1.

Referring specifically to FIGS. 1 though 3, a coupling 10 is provided for joining together the ends of two precast square cross section plain end concrete piles. The coupling 10 is comprised of an expandable sleeve member 15 and plates 50 and 55, all of which are made of metal. The sleeve 15 has outwardly flared entry portions 20 at each end thereof sized to receive end 26 of pile 25 and end 28 of pile 27 and align the piles and sleeve for engagement therebetween. The remainder of sleeve 15 initially has a uniform cross sectional shape as shown in FIG. 3. Sleeve 15 is formed to have two sets of spaced-apart wall members. The first set, wall members 22 and 24, are essentially flat and are initially spaced at a distance less than the width of piles 25 and 27. For example, if piles 25 and 27 have a fourteen inch width, wall members 22 and 24 are spaced thirteen and one-half inches apart. As shown in FIG. 2, one end 51 of flat horizontal plate 50 is secured, preferably by welding, to wall member 22 at the approximate vertical center thereof in a manner such that opposite end 52 of plate 50 extends inwardly across the space enclosed by sleeve 15. Likewise, end 56 of horizontal plate 55 is secured to the vertical center of wall member 24 so that end 57 extends across the space enclosed sleeve 15. Plates 50 and 55 prevent either pile 25 or 27 from entering sleeve 15 beyond its vertical center in a manner which allows wall members 22 and 24 to expand outwardly. The second set of wall members 30 and 34 are oriented transversely with respect to set of wall members 22 and 24. Wall members 30 and 34 each have central portions 31 and 35 which are also initially spaced at a distance less than the width of piles 25 and 27 and outside portions 32 and 36 respectively which extend outwardly beyond the area or space which piles 26 and 27 will later occupy. Therefore, since at least a portion of each wall member is spaced a distance less than the width of the piles, a portion of the perimeter of the sleeve is initially formed to encroach upon or invade the space which will ultimately be occupied by piles 25 and 27.

Figure 4:
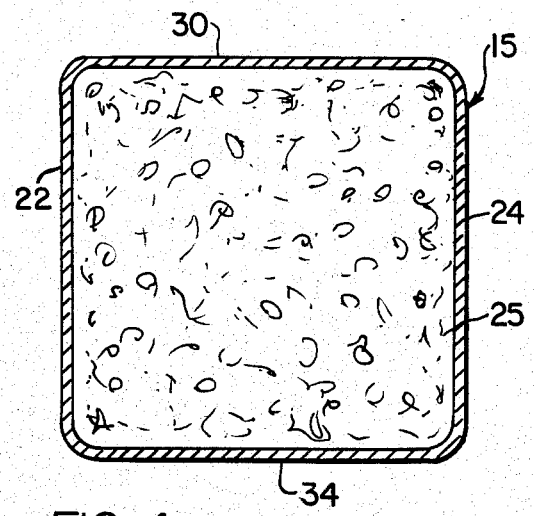
FIG. 4 is a transverse sectional view of the coupling corresponding to the view in FIG. 3 showing the coupling as expanded by the insertion of a pile end.

FIG. 4 illustrates the cross sectional configuration of sleeve 15 after the entry of a pile end. As shown, wall members 22 and 24 and central portions of wall members 30 and 34 are expanded outwardly so that the sleeve 15 fits tightly around one end of pile 25.

In using the coupling 10 a first pile 25 is driven into the ground in the usual manner. The lower end of sleeve 15 is then placed over upwardly facing end 26 of pile 25 in a manner so that flared entry portion 20 extends outwardly beyond the outer perimeter of pile 25 thereby aligning sleeve 15 directly above pile end 25. Sleeve 15 is prevented from sliding downwardly over pile end 26 by the inwardly extending portions of the sleeve perimeter. The lower end 28 of a second pile 27 is then lowered into the space defined by the flared entry portion 20 of the upper end of sleeve 15. Upper entry portion 20 aligns the second pile 27 directly above sleeve 15. Pile 27 is prevented from sliding downwardly into sleeve 15 by the inwardly extending portion of the sleeve.

A downwardly directed driving force applied to pile 27 causes the lower end of that pile, guided by entry portion 20 to enter sleeve 15. As pile 27 enters sleeve 15, the inwardly extending portion of the sleeve is deformed outwardly causing the sleeve to fit tightly over pile end 28. The downward driving force also forces sleeve 15 downwardly driving its lower end, guided by lower entry portion 20, over the upper end 26 of pile 25. As the sleeve is forced downwardly onto pile 25, the inwardly extending portion of the sleeve is deformed outwardly into the configuration shown in FIG. 5 causing the sleeve to fit tightly over end 26 of the pile. Outwardly extending portions 32 and 36 of wall members 30 and 34 provide sufficient material to allow ends 26 and 28 of piles 25 and 27 to enter sleeve 15 in the manner described above. As the driving force continues, pile 27 is driven into sleeve 15 until its downward motion is prevented by horizontally extending plate 50. Likewise, plate 55 prevents the sleeve from being driven onto pile 26 beyond the center of the sleeve. Because plates 50 and 55 are each only attached to one wall member, they provide an effective center stopping means while allowing all four wall members 22, 24, 30 and 34 to expand outwardly.

FIG. 5 shows a cross sectional view corresponding to the view shown in FIG. 2 of a modified embodiment of my invention. In this embodiment, a coupling 60 is provided which is identical in every respect to coupling 10 described above except for the following features. Coupling 60 utilizes a single center stopping plate 65 to replace plates 50 and 55 of coupling 10. One end 66 of plate 65 is secured to one side of sleeve 70 at the center thereof as shown. The opposite end 67 of plate 65 extends through a slot 72 provided in one side of sleeve 70. Except for slot 72, which is sized to receive end 67 of plate 65, sleeve 70 is identical to sleeve 15 described above. FIG. 6 shows coupling 60 as expanded outwardly by piles 25 and 27.

FIG. 7 illustrates one possible cross-sectional configuration of a coupling which could be used with hexagonal piling. In this embodiment a sleeve 80 is formed to have wall members 82, 84, 86, 88, 90 and 92. Wall members 82 and 84 each have central portions 81 and outwardly extending portions 83. The entire perimeter of the sleeve, with the exception of extending portions 83, is formed to encroach upon the space which will ultimately be occupied by a hexagonal cross section pile (not shown). As piles are driven into sleeve 80 in a manner described above, the sleeve expands outwardly to have a final cross sectional configuration shown by chain line 94, thereby securely holding the joined piles in alignment during driving.

While I have illustrated and described certain present preferred embodiments of my invention it is to be understood that the invention is not limited thereto and may be otherwise variously practiced within the scope of the following claims.

I claim:

1. A drive fit coupling for joining a pair of plain end precast piles each having a polygonal cross sectional configuration comprising:

(a) an expandable sleeve having entry portions at each end thereof sized to receive the piles and align the sleeve and piles for engagement therebetween, said sleeve otherwise having a cross sectional configuration generally the same as that of the piles and having a portion of its perimeter extending inwardly to encroach upon the space which will ultimately be occupied by the piles in a manner so that when the piles are driven into the sleeve, said inwardly extending portions of the sleeve perimeter are forced outwardly causing the sleeve to fit tightly over the ends of the piles; and (b) pile stopping means intermediate the ends of the coupling and comprising:

(i) a first horizontally oriented plate having one end thereof secured to one side of the sleeve and extending inwardly intermediate the ends of the sleeve; and (ii) a second horizotally oriented plate secured at one end thereof to an opposite side of the sleeve, said second plate also extending inwardly from the vertical center of the sleeve in a manner so that the first and second plates slide over each other as the piles are driven into the sleeve thereby allowing the sleeve to freely expand while preventing either pile from entering the sleeve beyond the vertical center of the sleeve.

2. A drive fit coupling according to claim 1 wherein said stopping means is a horizontally oriented plate having one end thereof secured to one side of the sleeve and extending inwardly from the vertical center of the sleeve and having the other end thereof inserted through a slot provided in an opposite side of the sleeve in a manner so that the plate allows the sleeve to freely expand as the piles are driven into the sleeve while preventing either pile from entering the sleeve beyond the vertical center of the sleeve.

* * * * *

UNITED STATES PATENT AND TRADEMARK OFFICE

CERTIFICATE OF CORRECTION

PATENT NO. : 4,537,534

DATED : August 27, 1985

INVENTOR(S) : Richard O. Marsh, JR.

It is certified that error appears in the above-identified patent and that said Letters Patent is hereby corrected as shown below:

Column 3, line 15, "26" should read -- 25 --.

Column 4, claim 1, line 49, "horizotally" should read -- horizontally --.

Signed and Sealed this

*Eighteenth* Day of *February 1986*

[SEAL]

*Attest:*

DONALD J. QUIGG

*Attesting Officer*

*Commissioner of Patents and Trademarks*